US005761562A

United States Patent [19]

Kobayashi

[11] Patent Number: 5,761,562

[45] Date of Patent: Jun. 2, 1998

[54] APPARATUS OF STORING AND FEEDING FILM LEADERS FOR USE IN A PHOTOGRAPHIC PROCESS

[75] Inventor: Masayuki Kobayashi, Wakayama, Japan

[73] Assignee: Noritsu Koki Co., Ltd., Wakayama, Japan

[21] Appl. No.: 708,672

[22] Filed: Sep. 5, 1996

[30] Foreign Application Priority Data

Sep. 18, 1995 [JP] Japan ..... 7-238577

[51] Int. Cl.[6] ..... G03D 3/00; G03D 3/08

[52] U.S. Cl. ..... 396/599; 396/612

[58] Field of Search ..... 396/570, 571, 396/612, 613, 620, 589, 594, 595, 598, 599

[56] References Cited

U.S. PATENT DOCUMENTS 5,373,338 12/1994 Yamaguchi et al. ..... 396/612

FOREIGN PATENT DOCUMENTS 193792 2/1986 European Pat. Off. ..... 396/937

*Primary Examiner*—D. Rutledge

*Attorney, Agent, or Firm*—Wenderoth, Lind & Ponack

[57] ABSTRACT

An apparatus of storing and then feeding film leaders or use in a photographic process includes guide rollers for guiding the leaders to a leader storage and transfer rollers for transferring the leaders from the leader storage. A leader orientation sensor is disposed before the entrance of the leader storage. A horizontal conveyor device located in the leader storage includes a plurality of leader holders mounted at equal intervals for holding the leaders loaded by the guide rollers. A lifting device unloads the leaders from the leader holders and delivers them one by one through the entrance of the leader storage.

9 Claims, 3 Drawing Sheets

APPARATUS OF STORING AND FEEDING FILM LEADERS FOR USE IN A PHOTOGRAPHIC PROCESS

BACKGROUND OF THE INVENTION

The present invention relates to an apparatus for storing and then feeding film leaders to a location where they are joined to corresponding sheets of undeveloped film for guiding them through an automatic development processor during photographic processing of the undeveloped film in the automatic development processor.

In a conventional manner for subjecting undeveloped film to a development process, each sheet of undeveloped image-bearing film is drawn out by hand from its cartridge and is manually joined at the leading end thereof by a piece of adhesive tape with a film leader in the form of a flat strip for guiding the film. This operation may be carried out using a splice gage in which leaders are taken out one by one from a stack and placed on a table of the splice gage for joining to the films. Each leader is oriented and must always be set on the splice gage table in a correctly oriented alignment without disorientation. However, it often happens that the leader is positioned incorrectly on the splice gage table.

Thus far there has not been provided an automatic leader feeder for feeding a plurality of leaders sequentially and correctly from storage.

The present invention has been developed in view of the foregoing, and an object of the invention is to provide an apparatus for storing and then feeding a plurality of film leaders which are aligned and stored neatly in a stack for use in a photographic process.

SUMMARY OF THE INVENTION

For achievement of the above object of the present invention, an apparatus for storing and feeding film leaders for use in a photographic process includes supply or guide rollers for guiding leaders to a leader storage and transfer or unloading rollers for transferring the leaders from the leader storage. A leader orientation sensor is disposed before the entrance of the leader storage. A horizontal conveyor device is located in the leader storage, and a plurality of leader holders are mounted at equal intervals on the horizontal conveyor device for holding the leaders loaded by the guide rollers. A lifting device unloads the leaders from the leader holders and delivers the leaders one by one through the entrance of the leader storage.

DETAILED DESCRIPTION OF THE PREFERRED EMBODIMENT

Figure 1:
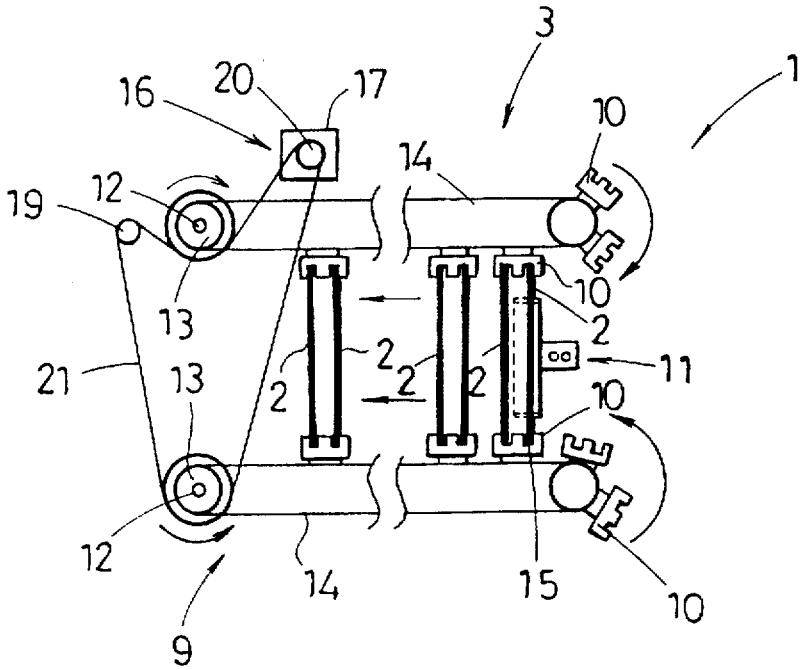
FIG. 1 is a schematic plan view of a primary part of an apparatus for storing and feeding film leaders according to the present invention.

A preferred embodiment of the present invention will be described referring to the accompanying drawings.

As shown in FIGS. 1 to 5, a leader storing and feeding apparatus 1 of the present invention for use in a photographic processor allows a plurality of film leaders 2 to be supplied and stored temporarily in a leader storage 3 and then to be delivered one by one from the storage 3 to a joint station where each leader 2 is joined to a sheet of undeveloped film (not shown).

A pair of guide rollers 4 are provided adjacent to an entrance of the leader storage 3 for supplying and guiding the leaders 2. The leaders 2 are driven to the leader storage 3 by being pinched between the two guide rollers 4. A leader detecting sensor 5 is provided upstream or before the guide rollers 4 for detecting the leading edge of a leader 2 and causing the guide rollers 4 to rotate and transfer the leader 2 into the leader storage 3. Provided adjacent to the guide rollers 4 are two pairs of transfer rollers **7*a* and 7*b* for feeding a leader 2 temporarily stored in the storage 3** to the next processing stage.

A leader direction sensor 8 is provided on the leader storage 3 side of the transfer rollers **7*a*, at a position adjacent to but outwardly of the entrance of leader storage 3, for detecting the direction or orientation of the leader 2 being transferred toward the leader storage 3 by the guide rollers 4 and the transfer rollers 7*a* operating as supply rollers. If the leader 2 is detected as being in a correctly oriented alignment, it is loaded to the leader storage 3. If not, the leader 2 is discharged by reverse rotation of the guide rollers 4 and the transfer rollers 7*a***.

The leader storage 3 includes a horizontal conveyor 9, leader holders 10, and a lifting device 11.

The horizontal conveyor 9 has two rotary shafts 12 extending vertically at opposite, front and rear, ends of the leader storage 3. Each rotary shaft 12 has two sprockets 13 mounted on upper and lower portions thereof. An endless chain 14 is mounted between the two corresponding sprockets 13 on respective rotary shafts 12 located at the front and the rear ends of storage 3. A pair of the endless chains 14 are aligned in parallel to each other and carry the leader holders 10 arranged at equal intervals therebetween. The endless chains 14 are driven by a single drive device 16. Each leader holder 10 has therein two longitudinal slits 15 for holding a pair of the leaders 2. More particularly, the longitudinal slits 15 extend from an uppermost end to near a lowermost end **10*a* of the leader holder 10**.

When the two endless chains 14 are driven by the drive device 16 in a reverse direction, the leader holders 10 on the endless chains 14 travel in the same direction. The drive device 16 comprises a drive motor 17, pulleys 18 mounted to the lower ends of respective rotary shafts 12, a tension pulley 19, a motor pulley 20 mounted on a drive haft **17*a* of the drive motor 17, and a belt 21. The belt 21 is arranged to run from the motor pulley 20 to the pulleys 18 of respective rotary shafts 12 and the tension pulley 19, as best shown in FIG. 1. Referring to FIG. 1, when the belt 21 is driven in one direction by the drive motor 17, the endless chains 14 travel to convey the leader holders 10 in the direction denoted by the arrows. If the drive motor 17 is rotated in a reverse direction, the leader holders 10 move back in an opposite direction towards the entrance of the leader storage 3**.

The lifting device 11 is located at the entrance of the leader storage 3 for transferring the leaders 2 to and from their respective leader holders 10. The lifting device 11 is driven by a drive device (not shown) so that a lifting table 23 having a V-shaped slot 22 can move upward and downward along guide shafts **23*a*. As a leader 2 stored in the longitudinal slits 15 of respective leader holders 10 is lifted, while its lowermost edge is engaged in the V-shaped slot 22 of the lifting table 23, it is unloaded from the leader storage 3 and delivered to the transfer rollers 7***a*. The lifting device 11 includes a detecting sensor 24 for detecting the location of each longitudinal slit 15 in a leader holder 10. When the sensor 24 detects that a target leader holder 10 carrying a pair of the leaders 2 and driven intermittently by the endless chains 14 has been delivered to the lifting device 11, the lifting table 23 is actuated to lift up one of the leaders 2 on the leader holder 10.

The leader storing and feeding apparatus 1 of the present invention having the above construction can be employed for carrying out film feeding operations in a photographic process.

Figure 3:
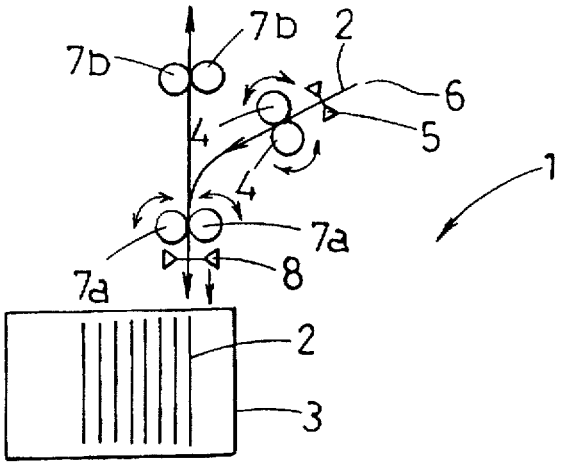
FIG. 3 is an explanatory view showing an operation of the apparatus for storing and feeding film leaders.
Figure 4:
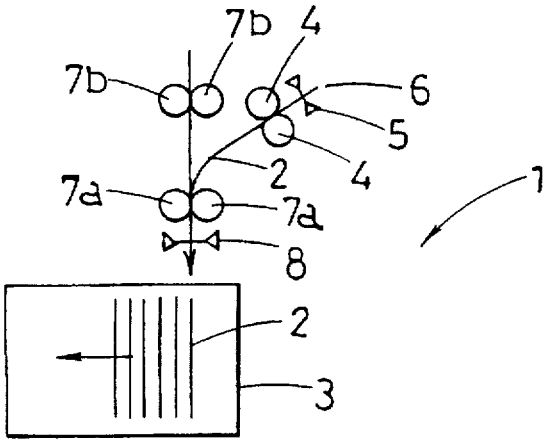
FIG. 4 is an explanatory view showing another operation of the apparatus of storing and feeding film leaders.
Figure 5:
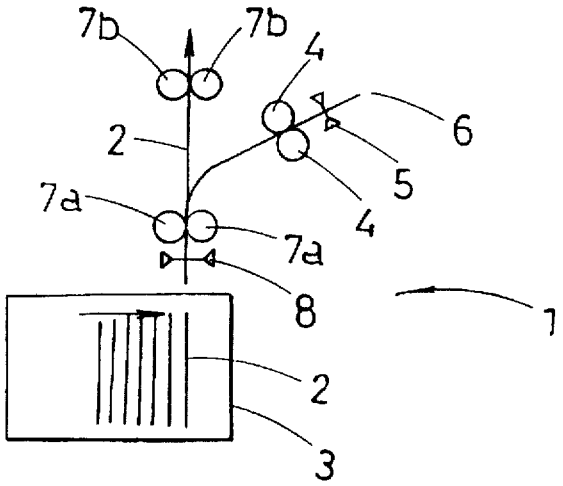
FIG. 5 is an explanatory view showing a further operation of the apparatus of storing and feeding film leaders.

The operation of the leader storing and feeding apparatus 1 will now be explained referring to FIGS. 3–5.

For storage in the leader storage 3, a group of leaders 2 are supplied one by one from a leader inlet 6. Upon each leader 2 being detected by the leader detecting sensor 5, it is advanced to the leader storage 3 by rotation of the supply rollers including guide rollers 4 and the transfer rollers 7*a*. The orientation of the leader 2 is then detected by the leader direction sensor 8 disposed before the entrance of the leader storage 3 and when it is correct, the leader 2 is advanced into the leader storage 3. If the detected orientation is not correct, the leader 2 is discharged by reverse rotation of the guide rollers 4 and the transfer rollers 7*a*.

Figure 2:
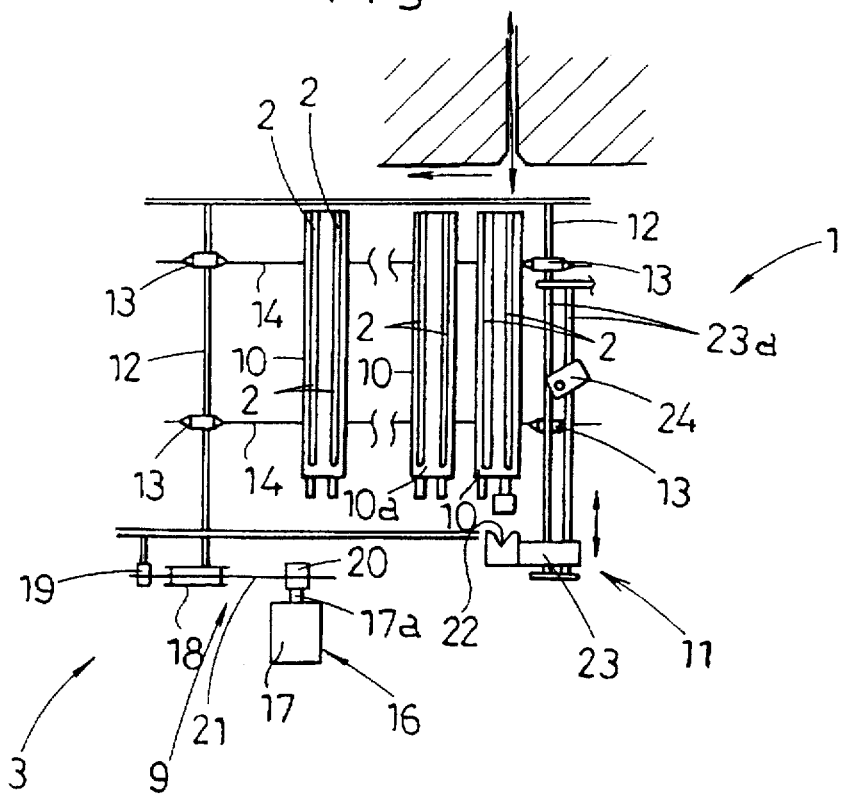
FIG. 2 is a schematic cross sectional view of the primary part of the apparatus for storing and feeding film leaders according to the present invention.

Before the correctly oriented leader 2 arrives at the leader storage 3, the horizontal conveyor 9 is actuated to locate respective opposed leader holders 10 at the position for receiving the leader 2, as shown in FIGS. 1 and 2. As the leader 2 is advanced into the leader storage 3, it moves into a corresponding one of the two longitudinal slits 15 of each of the leader holders 10 at the receiving position. Meanwhile, the lifting table 23 stays beneath the leader holders 10.

After the leader 2 is placed in the corresponding longitudinal slits 15 of the leader holders 10, the horizontal conveyor 9 is actuated to move the endless chains 14 slightly for locating the other of the two longitudinal slits 15 of the leader holders 10 at the leader receiving position. The leader holders 10 loaded with two of the leaders 2 are then conveyed inwardly of the leader storage 3. By repeating the above operation, a desired number of leaders 2 are stored in the leader holders 10.

When a stored leader is required for film processing, the leader 2 at the receiving position or entrance of the leader storage 3 is lifted by the lifting table 23 by being seated in the V-shaped slot 22 of the lifting table 23 and is delivered to the transfer rollers 7*a* and 7*b* operation as unloading rollers. The leader 2 is then driven by the transfer rollers 7*a* and 7*b* to the location for joining with a sheet of undeveloped film (FIG. 5).

Accordingly, a plurality of leaders 2 are stored in the leader storage 3 and when required are automatically unloaded in sequence from the leader storage 3 by repeating the foregoing operations.

I claim:

1. An apparatus for storing leaders and then for feeding the stored leaders for use in a photographic process, said apparatus comprising:

a leader storage having an entrance;

a horizontal conveyor device in said leader storage;

a plurality of leader holders mounted at equal intervals on said conveyor device;

a leader orientation detector located before said entrance of said leader storage for detecting a correct or incorrect alignment of leaders;

supply rollers for supplying leaders to said detector, for supplying the leaders through said entrance of said leader storage and into respective said leader holders when said detector detects said correct alignment, and for discharging the leaders without passage through said entrance when said detector detects said incorrect alignment;

unloading rollers located adjacent said entrance of said leader storage; and a lifting device for removing leaders stored in said leader holders and for delivering the thus removed leaders one by one through said entrance and to said unloading rollers.

2. An apparatus as claimed in claim 1, wherein said supply rollers include guide rollers for supplying leaders one by one from an inlet, and transfer rollers positioned downstream of said guide rollers relative to a direction of supply of the leaders to said entrance.

3. An apparatus as claimed in claim 2, wherein said leader orientation detector is positioned between said transfer rollers and said entrance.

4. An apparatus as claimed in claim 2, further comprising a leader detecting sensor positioned upstream of said guide rollers for detecting a leading end of a leader.

5. An apparatus as claimed in 2, wherein said unloading rollers comprise said transfer rollers and further transfer rollers positioned downstream of said transfer rollers relative to a direction of unloading of the leaders from said entrance.

6. An apparatus as claimed in claim 2, wherein said guide rollers and said transfer rollers are rotatable in a first direction of rotation to supply leaders in said direction of supply and are rotatable in an opposite direction of rotation to discharge the leaders in a direction opposite to said direction of supply.

7. An apparatus as claimed in claim 1, wherein said conveyor device is movable in a first direction in said leader storage to move leaders stored in said leader holders away from said entrance when leaders are being supplied into said entrance, and said conveyor device is movable in an opposite second direction in said leader storage to move leaders stored in said leader holders toward said entrance when leaders are being unloaded from said entrance.

8. An apparatus as claimed in claim 7, wherein said conveyor device is movable intermittently in said first and second directions.

9. An apparatus as claimed in claim 1, wherein each said leader holder includes plural means for supporting plural respective leaders.

* * * * *